US008317544B2

(12) United States Patent
Matsuoka et al.

(10) Patent No.: US 8,317,544 B2
(45) Date of Patent: Nov. 27, 2012

(54) MOUNTING STRUCTURE FOR SHIELDING SHELL

(75) Inventors: Hiroyuki Matsuoka, Yokkaichi (JP); Takuya Tate, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/407,854

(22) Filed: Feb. 29, 2012

(65) Prior Publication Data

US 2012/0238138 A1 Sep. 20, 2012

(30) Foreign Application Priority Data

Mar. 15, 2011 (JP) ..... 2001-056335

(51) Int. Cl.
*H01R 13/648* (2006.01)

(52) U.S. Cl. ..... 439/607.55; 439/95; 439/939

(58) Field of Classification Search ..... 439/607.55, 439/607.54, 607.56, 607.28, 939, 95
See application file for complete search history.

(56) References Cited

U.S. PATENT DOCUMENTS 5,718,605 A 2/1998 Morikawa et al.
6,786,770 B1 * 9/2004 Huang ..... 439/607.55
6,948,980 B2 * 9/2005 Xiang et al. ..... 439/607.23
7,179,125 B2 * 2/2007 Chen et al. ..... 439/607.28
7,261,592 B2 * 8/2007 Korsunsky et al. ..... 439/541.5
7,572,150 B2 * 8/2009 Matsuoka ..... 439/626
7,878,855 B2 * 2/2011 Li ..... 439/607.45
2001/0039143 A1 11/2001 Ikeda
2007/0249226 A1 * 10/2007 Yang et al. ..... 439/607
2008/0311793 A1 12/2008 Zhang et al.
2010/0216323 A1 8/2010 Kawamura et al.

FOREIGN PATENT DOCUMENTS

JP 2006-196198 7/2006

* cited by examiner

*Primary Examiner* — Tulsidas C Patel
*Assistant Examiner* — Travis Chambers
(74) *Attorney, Agent, or Firm* — Gerald E. Hespos; Michael J. Porco

(57) ABSTRACT

A mounting structure for a shielding shell (70) is provided for covering a housing (50) to be connected to a motor case. The mounting structure includes a metal plate (30) integrally to the housing (50) and adapted to attach the housing (50) to the motor case by mounting bolts. A first shielding shell (70A) has two overlapping pieces (76) and is adapted to cover the front side of the housing (50). A second shielding shell (70B) includes two fixing pieces (72) and is adapted to cover upper, left and right sides of the housing (50). The overlapping pieces (76) and the fixing pieces (72) are plates extending along the metal plate (30) and fastened together with the metal plate (30) to the motor case by the mounting bolts while being placed one over the other.

11 Claims, 9 Drawing Sheets

MOUNTING STRUCTURE FOR SHIELDING SHELL

BACKGROUND OF THE INVENTION

1. Field of the Invention

The invention relates to a mounting structure for a shielding shell.

2. Description of the Related Art

Japanese Unexamined Patent Publication No. 2006-196198 discloses a connector device with a shield for shielding high-frequency noise. This connector device has a connector and a shielding shell assembly. The connector is to be attached to a case that has a motor inside. The shielding shell assembly is made of metal and covers the connector. The shielding shell is composed of first and second shielding shells that are connected to each other. Both shielding shells are made of a metal plate using a metal flat plate material as a base material.

The first shielding shell is shield-connected to the case of the device and covers a rear part of the connector in a connecting direction with a mating connector. The second shielding shell covers a front part of a housing. Two contact pieces in the form of leaf springs are provided on a rear end portion of the second shielding shell and come into contact with the first shielding shell so that the second shielding shell is shield-connected to the case of the device via the first shielding shell.

The first and second shielding shells of the above-described connector device are in contact at only two points. Thus, shielding performance of the second shielding shell may be insufficient. As a countermeasure, it may be thought to prepare a separate metal plate made of aluminum die cast that would be connected electrically conductively to the case of the device. The two shielding shells then could be shield-connected to the case of the device via this metal plate. Specifically, the second shielding shell is shield-connected to the case of the device via the metal plate by providing the metal plate with bolt fastening portions. Bolts then are used to fasten the second shielding shell to these bolt fastening portions, thereby delivering sufficient shielding performance in the second shielding shell. However, a method for producing the metal plate by aluminum die cast has higher production cost than a method for producing a metal plate by press-working a metal flat plate material. Further, the bolt fastening operations increase as the number of contacts increases and hence production costs increase.

The present invention was completed in view of the above situation and an object thereof is to improve shielding performance.

SUMMARY OF THE INVENTION

The invention relates to a mounting structure for a shielding shell assembly that covers a housing of a device connector that is to be connected to a case of a device. The device connector comprises a metal plate integral to the housing and configured to receive at least one mounting bolt for attaching and fixing the housing to the case of the device. The shielding shell assembly comprises first and second shielding shells. The first shielding shell is configured to cover a first side of the housing and has a first mounting portion. The second shielding shell is configured to cover a second side of the housing and has a second mounting portion. The first and second mounting portions are in the form of plates that are placed over one another and along the metal plate. The mounting bolt then is used to fasten the first and second mounting portions and the plate together and to the case of the device. Thus, the first and second shielding shells can be shield-connected to the case of the device via the metal plate and shielding performance can be improved. An aluminum die cast metal can have a bolt fastening portion formed with an internal thread, but a metal plate material cannot be formed with an internally threaded bolt fastening portion. However, both shielding shells are fastened together at a bolt fastening portion where the metal plate is bolt-fastened to the case of the device. Thus, both shielding shells are shield-connected to the case of the device via the metal plate without additional fastening operations. Therefore, shielding performance is improved without increasing the bolt fastening operations while production cost is suppressed by using the metal plate.

The first shielding shell may include a front wall that at least partly covers the housing from front. The second shielding shell may include a ceiling wall that at least partly covers the housing from above and two side walls that are adjacent to the ceiling wall and cover the housing from lateral sides.

The first and second shielding shells may be formed integrally or unitarily by punching a flat metal plate into a specified shaped by a press and then bending the plate at a boundary between the front wall and the ceiling wall. Thus, the first and second shielding shells can be handled as a unit. Time and effort to assemble the shielding shells can be saved and the shielding shells can be fastened more easily together to the metal plate.

The front wall may include an extended wall projecting laterally from the side wall. The first mounting portion may project backward by bending a part of the extended wall toward the ceiling wall and the second mounting portion may project sideways by bending a part of the side wall toward the ceiling wall. Thus, the first and second mounting portions project in different directions and easily can be placed one over the other while being crossed.

The second mounting portion may have a bolt hole for receiving the mounting bolt at a side of the extended wall.

The lateral edge of the second mounting portion may extend straight from the rear end of the side wall toward the bolt hole. According to this construction, the rear end of the second shielding shell and the bolt hole of the second mounting portion are connected linearly and a current at the rear end of the second shielding shell easily can be allowed to escape to the bolt hole so that shielding performance can be improved.

The connector housing may include a fixing portion that at least partly covers an opening edge portion of the opening while exposing an outer peripheral edge portion of the metal plate.

The fixing portion may include a first side sliding portion slidable relative to a first surface side of the metal plate, a second side sliding portion slidable relative to the second surface side of the metal plate. A coupling may be arranged in the opening and couples the first and second side sliding portions.

The first mounting portion may be substantially in the form of a plate extending along the metal plate and in contact with a surface of the metal plate. The second mounting portion may be substantially in the form of a plate lifted away from the surface of the metal plate by the thickness of the fixing portion and extending along the surface of the metal plate.

The second mounting portion may have at least one bolt hole and a part around the bolt hole may be slightly lower than other parts. The lower surface of this slightly lower part may be in contact with a surface of the metal plate of the housing.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
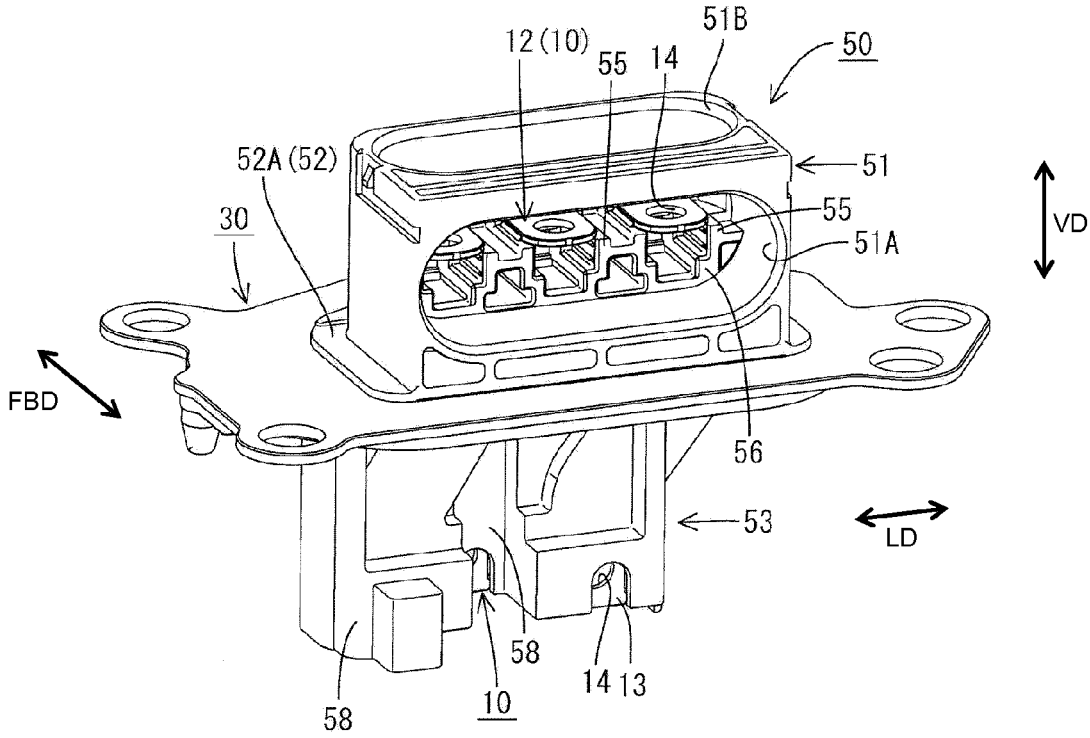
FIG. 1 is a perspective view of a terminal block according to an embodiment when viewed obliquely from front.
Figure 2:
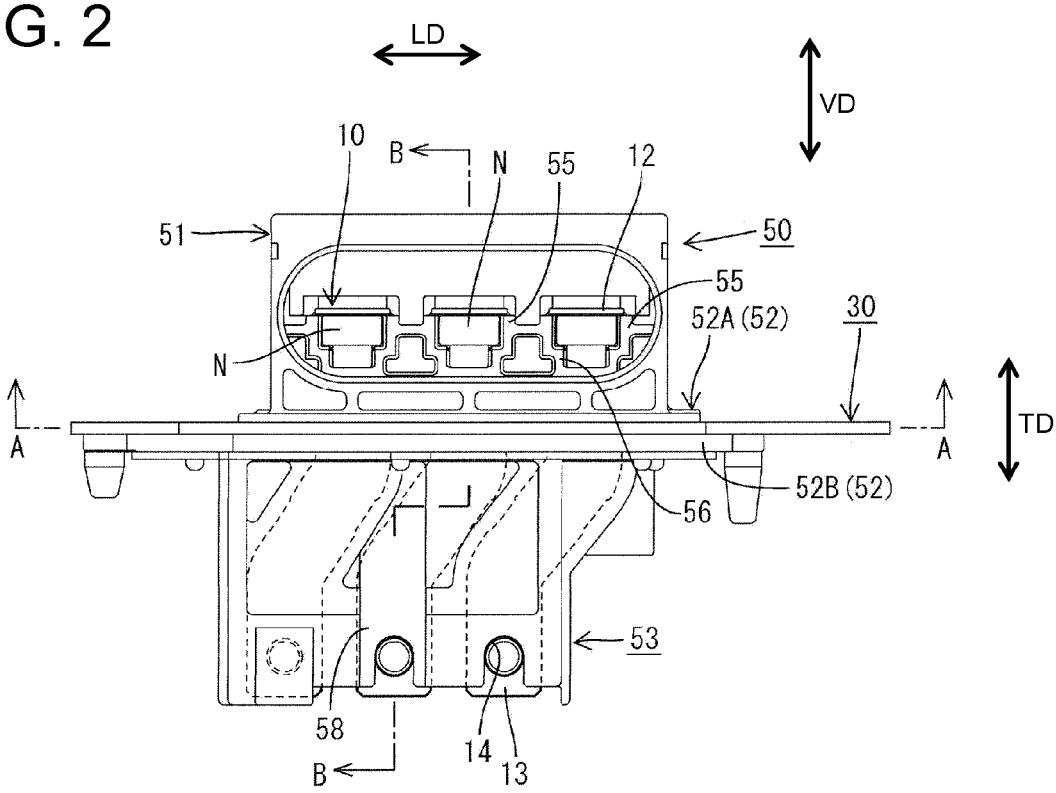
FIG. 2 is a front view of the terminal block.
Figure 3:
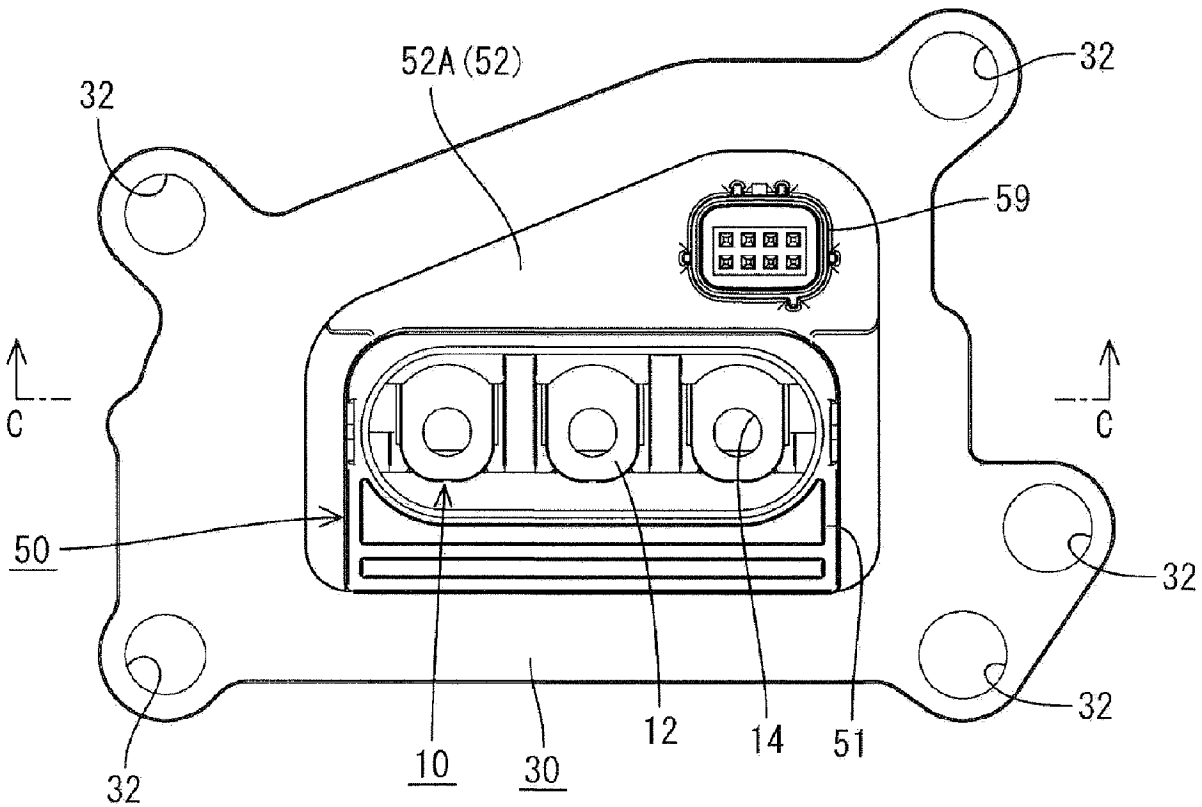
FIG. 3 is a plan view of the terminal block.

A terminal block in accordance with the invention is illustrated in FIGS. 1 to 10 and is to be attached to a metal motor case (not shown) that houses a motor. As shown in FIG. 3, this terminal block includes a metal plate 30 to be attached and fixed to the motor case, a housing 50 molded to be integral to the metal plate 30 and conductive plates 10 held in the housing 50 while penetrating through the metal plate 30 in a plate thickness direction TD. In the following description, a vertical direction VD is a vertical direction in FIG. 2, a lateral direction LD is a lateral direction in FIG. 2, and forward and backward directions FBD are lateral directions in FIG. 6 with a left side referred to as the front.

Figure 6:
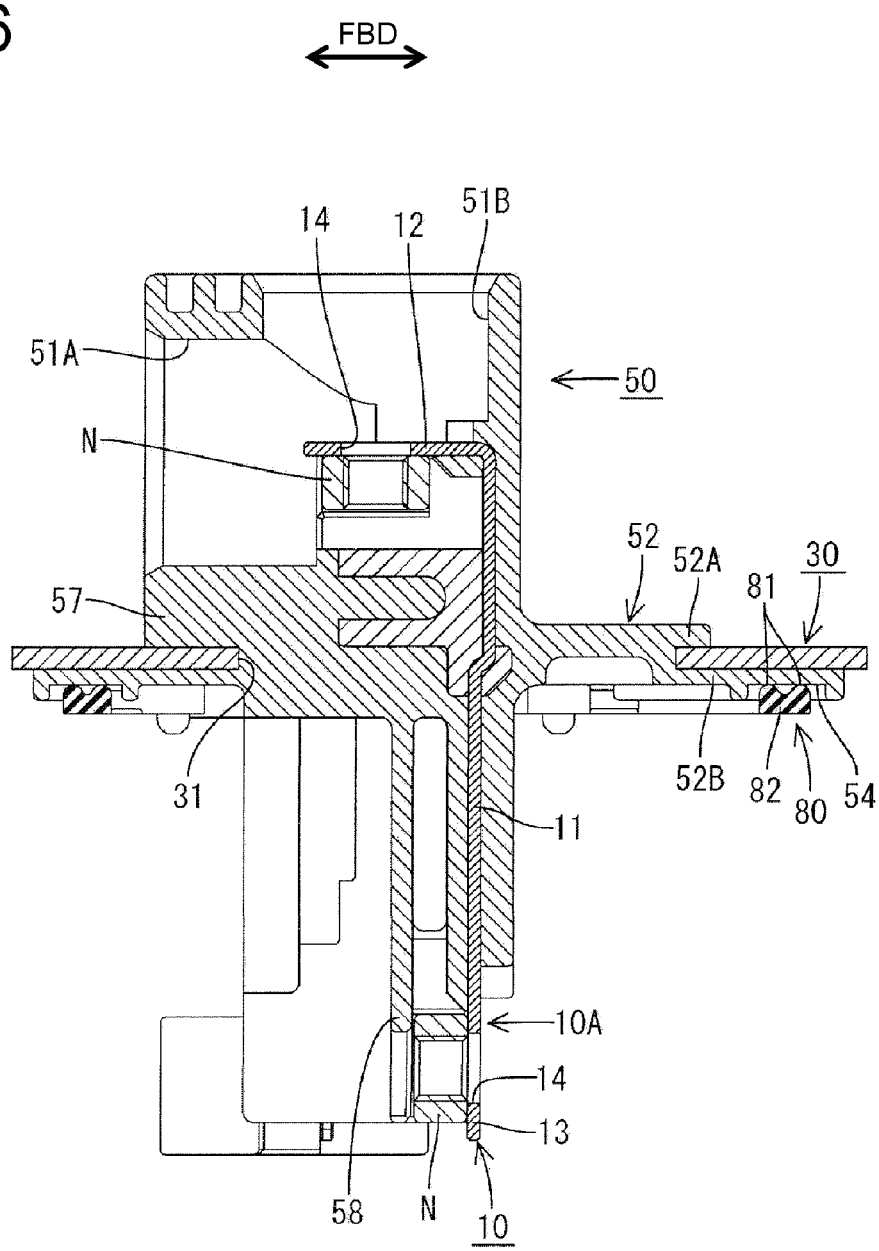
FIG. 6 is a section along B-B of FIG. 2.

Each conductive plate 10 is formed from a conductive metal plate with good electrical conductivity. The metal plate is punched or cut into a specified shape by a press, and then is subjected to a specified bending process. As shown in FIG. 6, the conductive plate 10 includes a terminal main portion 11, a wire-side fastening portion 12 extending forward from the upper end of the terminal main portion 11, and a device-side fastening portion 13 at a lower end of the terminal main portion 11. The terminal main portion 11 is formed longer than the wire-side fastening portion 12.

The device-side fastening portions 13 of the conductive plates 10 are to be bolt-fastened and connected electrically to device-side busbars (not shown) provided at the motor case. On the other hand, in an inverter or other such power supply device for supplying power, wires are arranged to extend toward the motor case and a wire-side connector (not shown) is provided at respective end portions of the wires. Wire-side terminals (not shown) connected to ends of the respective wire are provided in the wire-side connector and are bolt-fastened to the wire-side fastening portions 12 of the conductive plates 10 for electrical connection.

As shown in FIG. 2, three conductive plates 10 are arranged substantially side by side in the lateral direction LD. Further, the terminal main portions 11 are cranked slightly in the lateral direction LD at intermediate positions, as shown by broken line in FIG. 2. Each wire-side fastening portion 12 and each device-side fastening portion 13 has a bolt insertion hole 14 through which a fastening bolt (not shown) is insertable.

The terminal main portion 11 of the conductive plate 10 in the center position extends substantially in the vertical direction VD and is substantially flat as shown in FIG. 6. The lateral terminal main portions 11, 11 of the conductive plates 10 at the opposite left and right sides each has a facing portion 15 bent forward to face the wire-side fastening portion 12 at a substantially vertically central part of the terminal main portion 11 although not shown, and the front end of the facing portion 15 is bent down at substantially the same position as the front end of the wire-side fastening portion 12.

Figure 4:
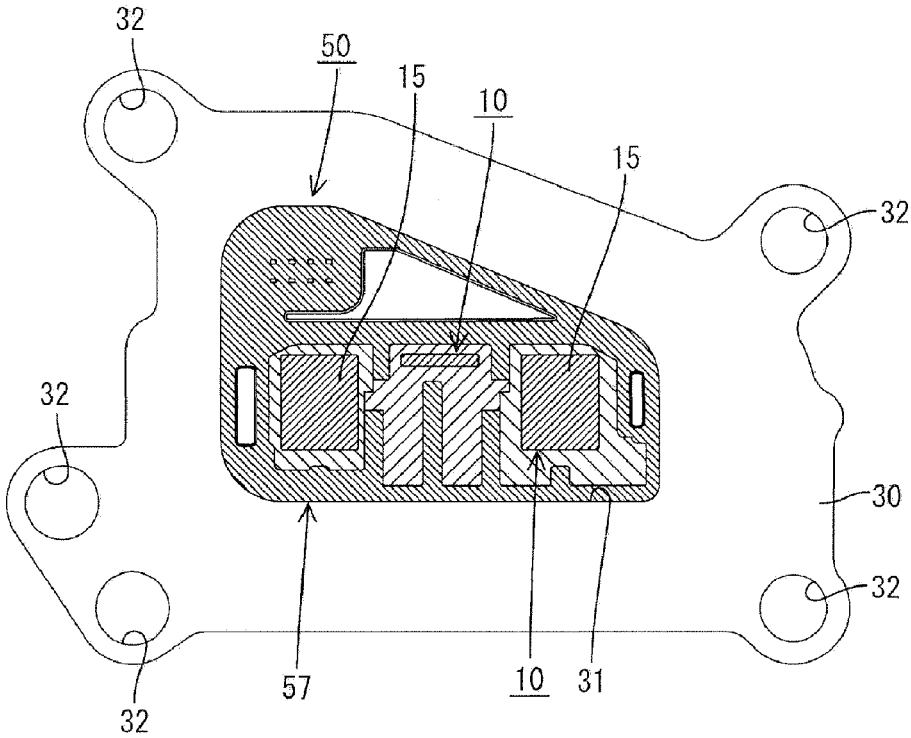
FIG. 4 is a section along A-A of FIG. 2.
Figure 5:
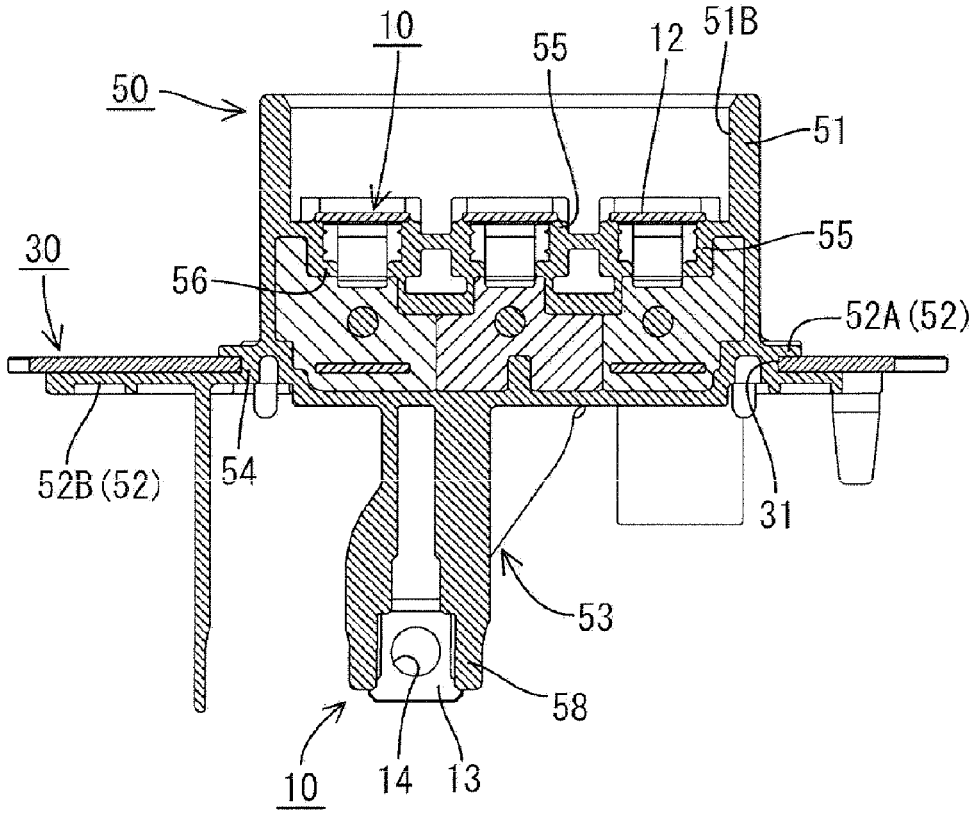
FIG. 5 is a section along C-C of FIG. 3.

As shown in FIG. 4, an opening 31 penetrates the metal plate 30 in a plate thickness direction TD of the plate material. As shown in FIG. 6, the housing 50 includes a wire-side fitting 51 above the metal plate 30. A substantially plate-like flange 52 is arranged at the height position of the metal plate 30 and bulges out sideways in a plane direction of the metal plate 30. A device-side fitting 53 is arranged below the metal plate 30. The housing 50 also includes a small connector portion 59 molded to be integral to the metal plate 30 and arranged to penetrate through the opening 31 in the vertical direction VD as shown in FIG. 3.

The wire-side fitting 51 is a wide box with a front opening 51A and an upper opening 51B, as shown in FIG. 1. The wire-side connector can fit into the front opening 51A of the wire-side fitting 51.

As shown in FIG. 3, three nut accommodating portions 55 are formed in the wire-side fitting 51 and are arranged substantially side by side in the lateral direction LD. The nut accommodating portions 55 are open forward and up. Further, all three nut accommodating portions 55 face forward through the front opening 51A and face up through the upper opening 51B. Nuts N are press-fit through the front end opening 51A from the front and are accommodated in the nut accommodating portions 55 so that the axis lines of the nuts N are aligned with the vertical direction VD.

The wire-side fastening portions 12 of the conductive plates 10 are arranged to close the upper end openings of the nut accommodating portions 55 as shown in FIGS. 3 and 4. Further, as shown in FIG. 6, each conductive plate 10 is arranged to penetrate through the opening 31 in the vertical direction VD and is held in the housing 50 so that the wire-side fastening portion 12 is arranged around the bolt insertion hole 14 and is exposed forward and up in the wire-side fitting 51. On the other hand, the device-side fastening portion 13 is arranged around the bolt insertion hole 14 and is exposed backward at the lower end of the device-side fitting 53. Each wire-side fastening portion 12 is exposed to the outside through the upper end opening 51B of the wire-side fitting 51. That is, the upper end opening 51B of the wire-side fitting 51 may be used as a service hole for insert a tool or the like for a bolt fastening operation. The wire-side terminal is placed on the wire-side fastening portion 12 and the tool is inserted inside through the upper end opening 51B to threadedly engage the fastening bolt with the nut N, so that the conductive plate 10 and the wire-side terminal are connected electrically. Note that a service cover (not shown) is mounted on or to the upper end opening 51B of the wire-side fitting portion 51 after bolt fastening, thereby closing the upper end opening 51B.

An escaping recess 56 is provided below each nut accommodating portion 55 for allowing a leading end part of the fastening bolt penetrating through the nut N to escape when the fastening bolt is fastened to the nut N. The escaping recess 56 is narrower than the nut accommodating portion 55 in the lateral direction LD and is formed unitarily with the nut accommodating portion 55 by a slide die.

The flange 52 covers an opening edge portion of the opening 31 over substantially the entire periphery circumference, while exposing an outer peripheral edge of the metal plate 30.

The flange 52 fixes the housing 50 on the metal plate 30 and sandwiches the metal plate 30 in a plate thickness direction TD. Specifically, as is clear from FIG. 3, a wire-side flange 52A at a side of the wire-side fitting 51 extends in the lateral direction LD and back. As is clear from FIGS. 5 and 6, a device-side flange 52B at a side of the device-side fitting 53 covers a surface of the metal plate 30 at the side of the device-side fitting 53.

The opening 31 has a substantially trapezoidal shape as shown in FIG. 4. Further, the facing portions 15 of the conductive plates 10 at the left and right sides and the terminal main portion 11 of the central conductive plate 10 are arranged in the opening 31. On the other hand, a thick portion 57 having a thick resin layer is formed from a lower part of the wire-side fitting 51 to an upper part of the device-side fitting portion 53 as shown in FIG. 6. That is, the three conductive plates 10 having a complicated shape penetrate through the opening 31 of the metal plate 30 in this thick portion 57.

The device-side fitting 53 is housed in the motor case when the terminal block is fixed to the motor case. Further, as shown in FIG. 1, three nut accommodating portions 58 are formed in the device-side fitting 53. Specifically, the nut accommodating portion 58 in the center position is arranged behind the other nut accommodating portions 58. The fastening bolts are engaged threadedly with respective nuts N in the nut accommodating portions 58 of the device-side fitting 53 for electrically connecting the conductive plates 10 and the device-side busbars similar to the nut accommodating portions 55 of the wire-side fitting 51. In this way, the wire-side terminals and the device-side busbars are connected electrically using the conductive plates 10 as intermediate terminals.

As shown in FIG. 6, a packing mounting groove 54 is formed in the device-side flange 52B and can receive a packing 80. The packing 80 is made of a resilient material, such as rubber, and annular lips 81 are formed on a sealing surface to the packing mounting groove 54. A surface of the packing 80 opposite to the surface with the annular lips 81 defines a surface sealing portion 82 to be sealed surface sealed to the motor case. A pressing force required to press the annular lip(s) 81 for sealing can be small. Accordingly, it is not necessary to particularly ensure strength by increasing the thickness of the metal plate 30 and sufficient sealing performance can be obtained with a smaller pressing force than in the case of using a metal plate made of aluminum die cast.

Mounting holes 32 are formed in the outer peripheral edge of the metal plate 30, as shown in FIG. 4 and fixing bolts or rivets (not shown) can be inserted through these mounting holes 32 and fastened to the motor case so that the terminal block can be attached to the motor case. Two mounting holes 32 arranged at a front edge of the metal plate 30 also are used to shield connect the shielding shell 70 to the motor case.

Figure 7:
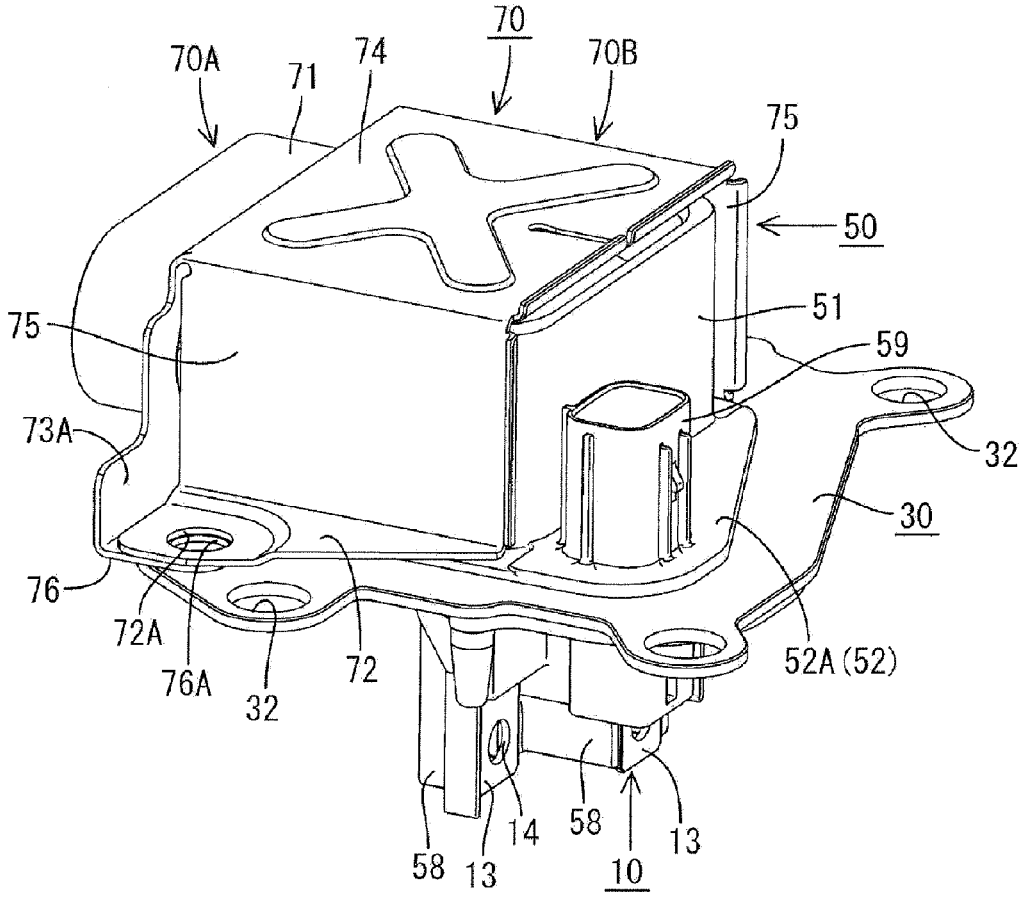
FIG. 7 is a perspective view of the terminal block with a mounted shielding shell when viewed obliquely from behind.
Figure 8:
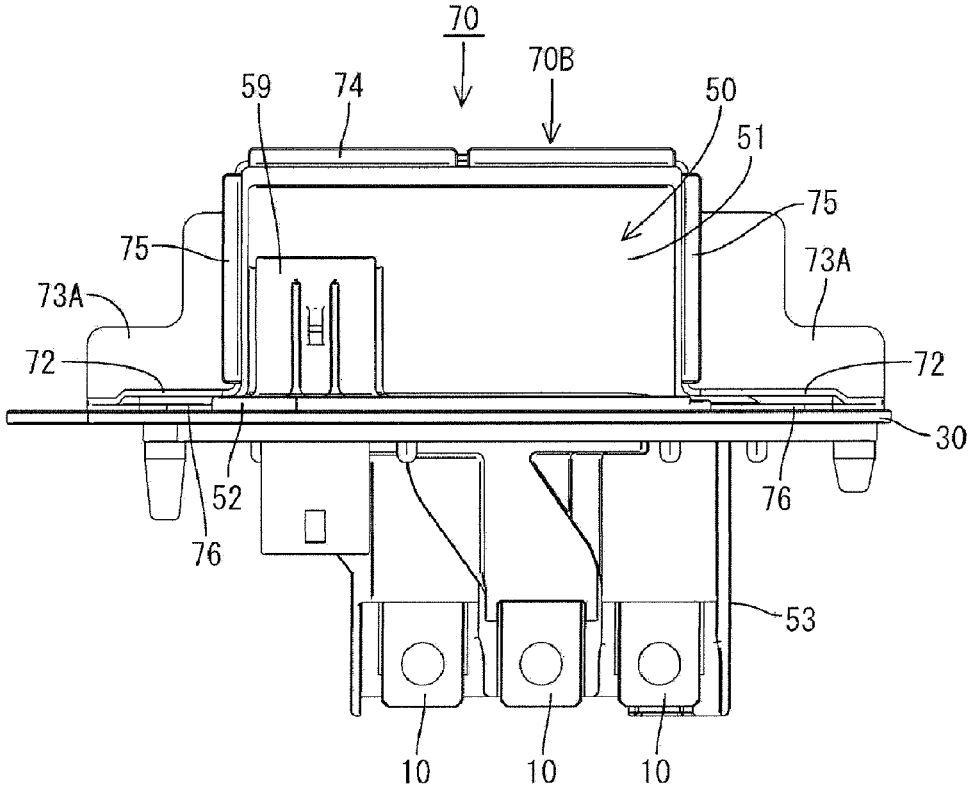
FIG. 8 is a rear view of the terminal block with the mounted shielding shell.
Figure 9:
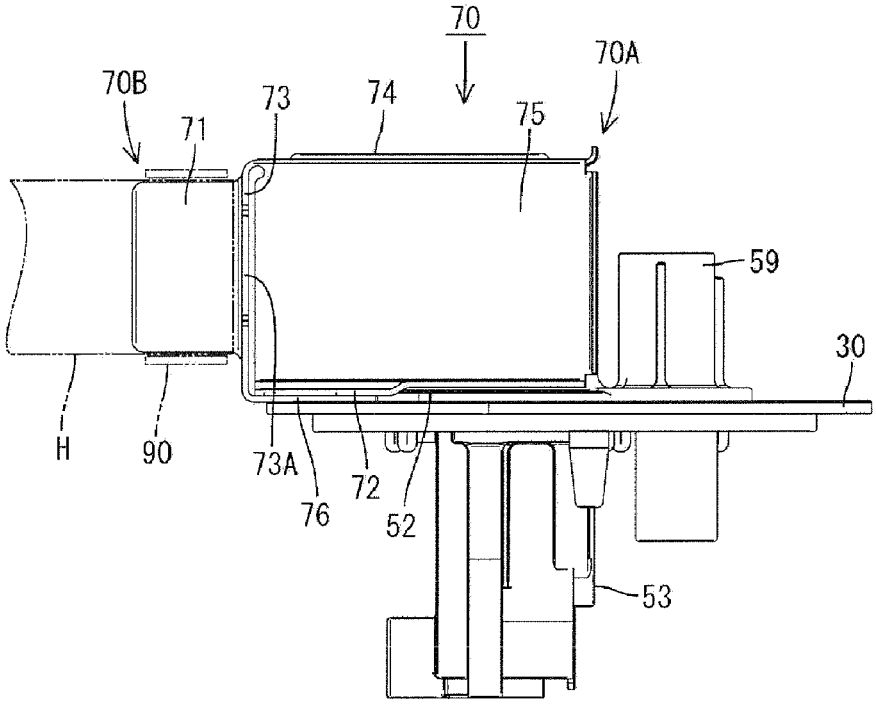
FIG. 9 is a side view of the terminal block with the mounted shielding shell.

As shown in FIGS. 7 to 9, the shielding shell 70 is made of a conductive material, such as metal, and substantially covers the wire-side fitting 51 while exposing only the rear surface of the wire-side fitting 51 toward the rear side. The shielding shell 70 is formed by punching or cutting a metal plate with good electrical conductivity into a specified shape by a press and then performing a specified bending on the punched or cut plate. Specifically, the shielding shell 70 has a first shielding shell 70A for covering the front surface of the wire-side fitting portion 51 and a second shielding shell 70B for at least partly covering the upper, left and right surfaces of the wire-side fitting 51. The shielding shell 70 is mounted by being slid back from the front of the housing 50. Thus, a mount opening for receiving the wire-side fitting 51 is open backward at a position of the shielding shell 70 corresponding to the rear surface of the wire-side fitting 51.

Figure 10:
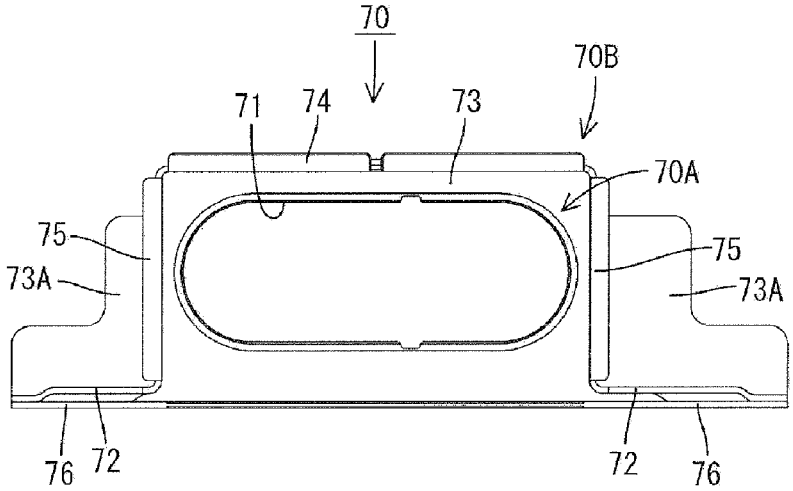
FIG. 10 is a rear view of the shielding shell.

As shown in FIG. 10, the first shielding shell 70A includes a front wall 73 that at least partly covers the wire-side fitting 51 from the front. The front wall 73 includes extended walls 73A extending in the lateral direction LD. A wide elliptical crimp tube 71 projects forward from the front wall 73 and is to be connected electrically to a wire H that shields conductive paths of the wire-side connector. Specifically, the crimp tube 71 has a crimping surface to be crimped and connected to a braided wire H that collectively covers shielded conductive paths of the wire-side connector, as shown in FIG. 9. The braided wire H is shield-connected to the crimp tube 71 by crimping the braided wire H between the crimping surface of the crimp tube portion 71 and a crimp ring 90.

The second shielding shell 70B includes a ceiling wall 74 that at least partly covers the wire-side fitting 51 from above and two side walls 75 that are adjacent to the ceiling wall 74 and at least partly cover the wire-side fitting 51 from left and right sides. Fixing pieces 72 project sideways at lower edges of the side walls 75. Bolt holes 72A penetrate through front end portions of these fixing pieces 72 in the plate thickness direction TD and can receive the mounting bolts.

The extending walls 73A of the front wall 73 project sideways from the side walls 75 of the second shielding shell 70B. Overlapping pieces 76 project back from the lower ends of the extended walls 73A and bolt holes 76A penetrate through the overlapping pieces 76 in the plate thickness direction TD for receiving the respective mounting bolts. Further, the overlapping pieces 76 are arranged below the fixing pieces 72 so that the upper surfaces of the overlapping pieces 76 are in substantially surface contact with the lower surfaces of the fixing pieces 72. The bolt holes 76A of the overlapping pieces 76 and the bolt holes 72A of the fixing pieces 72 have substantially the same diameter and are arranged coaxially one above the other.

The first and second shielding shells 70A and 70B are coupled integrally at the front edge of the ceiling wall 74. That is, the first and second shielding shells 70A and 70B are formed unitarily by bending the front wall 73 toward the side walls 75 using a boundary part between the front wall 73 and the ceiling wall 74 as a bending edge after a metal flat plate is punched or cut into a specified shape by a press. Further, the overlapping pieces 76 are formed by bending lower end portions of the extended walls 73A toward the ceiling wall 74, and the fixing pieces 72 are formed by bending lower end portions of the side walls 75 toward the ceiling wall 74.

The overlapping pieces 76 are plates extending in surface contact with the upper surface of the metal plate 30. The fixing pieces 72 are plates lifted up from the upper surface of the metal plate 30 by the thickness of the flange 52 and extend along the upper surface of the metal plate 30. Parts of the fixing pieces 72 around the bolt holes 72A are slightly lower than the other parts, and the lower surfaces of these slightly lower parts are in surface contact with the upper surface of the metal plate 30 of the housing 50. The bolt holes 72A of the fixing pieces 72, the bolt holes 76A of the overlapping pieces 76 and the mounting holes 32 of the metal plate 30 are substantially coaxial when the wire-side fitting 51 is covered by the shielding shell 70. The first and second shielding shells 70A and 70B are shield-connected to the motor case via the metal plate 30 by inserting the mounting bolts through the holes 72A, 76A and 32 and fastening the mounting bolts to the motor case.

Lateral edges of the fixing pieces 72 extend straight from the rear ends of the lower edges of the side walls 75 toward the bolt holes 72A. Thus, the fixing pieces 72 have a substantially isosceles triangular plan view (see e.g. FIG. 7). A current can flow at a shortest distance from a rear end of the second shielding shell 70B toward the bolt holes 72A of the fixing pieces 72. As a result, the current based on high-frequency noise absorbed by the rear end portion of the second shielding shell 70B easily can escape or flow to the bolt holes 72A through the lateral edges of the fixing pieces 72. Therefore shielding performance at the rear of the second shielding shell 70B is good.

A current based on high-frequency noise absorbed by the front wall 73 flows into the motor case via the extended walls 73A, the overlapping pieces 76 and the metal plate 30. Further, a current based on high-frequency noise absorbed by the braided wire H similarly can flow into the motor case via the extended walls 73A, the overlapping pieces 76 and the metal plate 30. On the other hand, a current based on high-frequency noise absorbed by the ceiling wall 74 can flow into the motor case via the side walls 75, the fixing pieces 72, the overlapping pieces 76 and the metal plate 30. Further, a current based on high-frequency noise absorbed by the side walls 75 also similarly can flow into the motor case via the fixing pieces 72, the overlapping pieces 76 and the metal plate 30.

As described above, the overlapping pieces 76 of the first shielding shell 70A and the fixing pieces 72 of the second shielding shell 70B are placed one over the other and fastened simultaneously with the metal plate 30 to the motor case. Thus, shielding performance of the second shielding shell 70B is improved drastically without increasing the number of bolt fastening operations. Further, the use of the metal plate 30 reduces material cost and production cost. Additionally, the fixing pieces 72 and the overlapping pieces 76 are fastened simultaneously, thereby facilitating assembly.

The first and second shielding shells 70A and 70B are formed unitarily. Thus, it is not necessary to assemble the shielding shells 70A, 70B together. Furthermore, the overlapping pieces 76 project back and the fixing pieces 72 project sideways. Therefore, the overlapping pieces 76 and the fixing pieces 72 easily can be placed one over the other while being crossed. Further, the lateral edges of the fixing pieces 72 extend substantially straight from the rear ends of the lower edges of the side walls 75 toward the bolt holes 72A. Thus, a current is allowed to more easily escape to the bolt holes 72A from the rear of the second shielding shell 70B and shielding performance is improved.

The invention is not limited to the above described embodiment. For example, the following embodiments also are included in the scope of the invention.

Although the first shielding shell 70A and the second shielding shell 70B are integrally or unitarily formed in the above embodiment, the two shielding shells may be separately formed and assembled later according to the present invention.

Although projecting directions of the overlapping pieces 76 and those of the fixing pieces 72 substantially are perpendicular in the above embodiment, the projecting directions of the overlapping pieces 76 and those of the fixing pieces 72 may be same or arranged at a different angle with respect to each other according to the present invention. That is, the overlapping pieces may be formed e.g. to project forward from the lower edges of the extended walls and the fixing pieces may be formed to project forward from the positions of the bolt holes 72A in the above embodiment.

Although the lateral edges of the fixing pieces 72 are formed to be substantially straight from the rear ends of the lower edges of the side walls 75 toward the bolt holes 72A in the above embodiment, the lateral edges of the fixing pieces 72 may be curved or extend at right angles according to the invention.

Although a pair of fixing pieces 72 and a pair of overlapping pieces 76 are provided in the above embodiment, one fixing piece and one overlapping piece may be provided or three or more fixing pieces and three or more overlapping pieces may be provided according to the invention.

What is claimed is:

1. A shielded device connector to be connected to a case of a device, comprising:

a metal plate having an outer periphery, an opening inward of the outer periphery and at least one mounting hole between the outer periphery and the opening for receiving a mounting bolt to mount the device connector to the case;

a housing integrally joined to the metal plate at the opening so that the mounting hole of the plate is outward of the housing;

a first shielding shell configured to cover a first side of the housing and including a first mounting plate projecting outward of the housing; and a second shielding shell configured to cover at least a second side of the housing and including a second mounting plate projecting outward of the housing;

the first and second mounting plates being placed one over the other and extending along portions of the metal plate outward of the housing, bolt holes being formed through the mounting plates and being registered with the mounting hole in the metal plate so that the first and second shielding shells can be fastened with the metal plate to the case by the mounting bolt at a position outward of the housing.

2. The shielded device connector of claim 1, wherein:

the first shielding shell includes a front wall that at least partly covers a front of the housing; and the second shielding shell includes a ceiling wall that at least partly covers the housing from above and two side walls that are adjacent to the ceiling wall and at least partly cover the housing from lateral sides.

3. The shielded device connector of claim 1, wherein a part of the second mounting plate around the bolt hole therein is slightly lower than other parts, and has a lower surface arranged in contact with a surface of the metal plate of the housing.

4. A mounting structure for a shielding shell for at least partly covering a housing of a device connector to be connected to a case of a device, comprising:

a metal plate integrally joined to the housing and configured to attach the housing to the case by being fastened to the case by at least one mounting bolt;

a first shielding shell configured to cover at least part of a front of the housing and including a first mounting plate; and a second shielding shell including a ceiling wall that at least partly covers the housing from above and two side walls that are adjacent to the ceiling wall and at least partly cover the housing from lateral sides, the second shielding shell including a second mounting plate; wherein the first and second shielding shells are formed unitarily and are bent at a boundary between the front wall and the ceiling wall; and the first and second mounting plates extend along the metal plate and are fastened with the metal plate to the case by the mounting bolt while being placed one over the other.

5. The mounting structure for a shielding shell of claim 4, wherein the housing includes a fixing portion that at least partly covers an opening edge of an opening in the metal plate while exposing an outer peripheral edge of the metal plate.

6. The mounting structure for a shielding shell of claim 4, wherein the front wall includes an extended wall projecting laterally from the side wall.

7. The mounting structure for a shielding shell of claim 6, wherein the first mounting plate projects back by bending a part of the extended wall toward the ceiling wall; and the second mounting portion projects laterally by bending a part of the side wall toward the ceiling wall.

8. The mounting structure for a shielding shell of claim 6, wherein the second mounting portion is formed with a bolt hole at a side of the extended wall for receiving the mounting bolt.

9. The mounting structure for a shielding shell of claim 8, wherein a lateral edge of the second mounting portion extends substantially straight from the rear end of the side wall toward the bolt hole.

10. A shielded device connector to be connected to a case of a device, comprising:

a metal plate configured to be fastened to the case by at least one mounting bolt, the mounting plate being formed with an opening;

a connector housing having a fixing portion with a first side sliding portion slidable relative to a first surface side of the metal plate, a second side sliding portion slidable relative to a second surface side of the metal plate and a coupling arranged in the opening of the metal plate and coupling the first and second side sliding portions while exposing an outer peripheral edge of the metal plate;

a first shielding shell configured to cover a first side of the housing and including a first mounting plate; and a second shielding shell configured to cover at least a second side of the housing and including a second mounting plate;

wherein the first and second mounting plates extend along the metal plate and are fastened with the metal plate to the case by the mounting bolt while being placed one over the other.

11. The shielded device connector of claim 10, wherein the first mounting portion substantially is a plate substantially extending along the metal plate and in contact with a surface of the metal plate, and the second mounting plate substantially is a plate lifted from the surface of the metal plate by the thickness of the fixing portion and extending along the surface of the metal plate.

* * * * *